US006273625B1

(12) United States Patent
Martinez de San Vincente Oliveras

(10) Patent No.: US 6,273,625 B1
(45) Date of Patent: Aug. 14, 2001

(54) WAX APPLICATOR WITH REMOVABLE SIDE COVER

(75) Inventor: Luis Martinez de San Vincente Oliveras, Cornella de Llobregat (ES)

(73) Assignee: Ceras Especial Martinez de San Vincente, S.A., Cornella de Llobregat (ES)

( * ) Notice: Subject to any disclaimer, the term of this patent is extended or adjusted under 35 U.S.C. 154(b) by 0 days.

(21) Appl. No.: 09/555,206

(22) PCT Filed: Nov. 27, 1998

(86) PCT No.: PCT/ES98/00326

§ 371 Date: May 26, 2000

§ 102(e) Date: May 26, 2000

(87) PCT Pub. No.: WO99/29207

PCT Pub. Date: Jun. 17, 1999

(30) Foreign Application Priority Data

Dec. 10, 1997 (ES) ..... P 9702562

(51) Int. Cl.[7] ..... A45D 40/00; A45D 34/04

(52) U.S. Cl. ..... 401/1; 219/424; 219/478; 401/192; 401/194; 401/208

(58) Field of Search ..... 401/1, 2, 192, 401/194, 208; 219/417, 424, 427, 478

(56) References Cited

U.S. PATENT DOCUMENTS 4,773,784 * 9/1988 Mann ..... 401/1
5,154,522 * 10/1992 Nobilec ..... 401/1

FOREIGN PATENT DOCUMENTS

460334 * 12/1991 (EP) .
2028739 7/1992 (ES) .
2659204 9/1991 (FR) .

* cited by examiner

*Primary Examiner*—Gregory L. Huson
*Assistant Examiner*—Kathleen J. Prunner
(74) *Attorney, Agent, or Firm*—Sughrue, Mion, Zinn, Macpeak & Seas, PLLC

(57) ABSTRACT

A wax applicator for depilation has one of its side walls forming a removable cover having transparent or partially transparent properties. The body of the applicator presents a U-shaped outline designed to permit insertion of a wax cartridge. The cover has sensors and/or windows for viewing the characteristics of the cartridge wax. The body of the application has a removable top forming a protective cover over the wax cartridge to shelter it thermally.

5 Claims, 2 Drawing Sheets

7
5
4'
6
3
1
2
4
9

WAX APPLICATOR WITH REMOVABLE SIDE COVER

CROSS-REFERENCE TO RELATED APPLICATIONS

This is a continuation of PCT Application No. PCT/ES98/00326, filed Nov. 27, 1998.

BACKGROUND OF THE INVENTION

It is common knowledge that to apply wax in the world of beauty treatments various pieces of apparatus or small appliances are needed in order to facilitate the operation. The application of wax for depilation is a task of itself quite uncomfortable for users, since it requires a heating reservoir, an applicator spatula and other items for removing the down or hair, once the wax has been applied.

As it has been possible to appreciate through the development of the art in these tasks, one of the best solutions has come through the use of cartridges filled with wax which is dispersed over the most appropriate surface, by means of incorporation of a roller into the head of the cartridge. Such techniques have been improved over time, to achieve a combination in a single body of the cartridge with the wax and the roller-applicator, and a sleeve which covers it and is provided with an electrical heating system, consisting in electrical elements being attached to the sleeve and, when activated, heating the sleeve; this then heats the cartridge and, therefore, the wax melts to the degree of fluidity required for emergence through the roller and consequent application.

Two types of applicator using the above technology are known. One is always connected to the electrical current or is dependent upon it by the interrelation of an electrical feed cord, while the other has a supporting base that provides connection to the current so that when the applicator is detached from the base the applicator is disconnected from said electrical current and it is left at working temperature, which means that users can act in greater freedom and safety. Both systems are highly effective, and some details of such systems have been the object of prior patents.

Document ES-A-2 028 739 discloses a wax applicator using a supporting base that provides connection to the current. Document FR-A-2 659 204 also discloses a wax applicator of well known kind. In both cases the case or reservoir that contains the wax is inserted into the main body of the applicator through an opening placed in the upper area of said main body.

However, the system of applicator with cartridge, sleeve and heating based on the sleeve suffers from the defect of not having sufficient control means, since with the cartridge incorporated into the sleeve and the latter inside the applicator, when all their side walls are opaque, it is not possible to see the wax content or find out its characteristics and state, such as its ideal temperature, its type, quality, fluidity or other specification that can only be learned by looking at it.

Another disadvantage lies in the fact that as the cartridge has to be inserted through this mouth of the applicator this mouth has to be wide, and that prevents it being able to house the zone of the cartridge which contains the roller, that is the head, which is detrimental to the heat output of the appliance.

SUMMARY OF THE INVENTION

The object of this invention has been designed in order to solve these difficulties and, as will be outlined, consists in an improved wax applicator for depilation, whose constructional characteristics mean that, in addition to fulfilling its specific function, a full view can be obtained of the wax content and in some embodiments the temperature, fluidity as well as other characteristics of same that assist the work of users.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

This invention therefore consists in a wax applicator for depilation of the type made up of a wax cartridge with a roller in its head, which cartridge is, inserted into an electrically heat-activated sleeve, the whole being inserted into the body of the applicator, characterized in that one of the side walls of the applicator is incorporated into same by being secured removably to function as a cover, this wall having transparent or partially transparent properties in accordance with the material of which it is made, and presenting a shape complementary to the other walls of the applicator, so that once incorporated it constitutes a single body. Said removable wall can be fitted with temperature sensors and/or viewing windows, and sensors and/or viewing windows to show the characteristics of the wax contained in the cartridge. Another special feature is that the wall, due to being removable, permits insertion of the wax-containing cartridge by simple side entry, so that the body is totally constituted when the opening of U-shaped outline presented by the applicator with its heat-activated sleeve is adapted to permit complementary insertion of the wax cartridge with its roller head; and then the U-shaped opening is covered by the sidewall, also complementary and partially or totally transparent, which is fitted onto the rest of the body by snapping on and off.

One of the advantages of this invention lies in the fact that, given that the cartridge is inserted from the side and not through the mouth of the applicator, the latter can be made longer, covering and sheltering part of the roller and permitting more effective and uniform heating, for it is not necessary in this case to detach the head from the entire body, as the whole cartridge does not have to enter through it, since the cartridge passes in from the sides. The operation is simple and effective: insertion of the cartridge is permitted simply by placing it in the U-shaped side opening in the applicator-sleeve body; it is then closed by the complementary transparent or partially transparent wall, resulting in a complete applicator ready for operation.

The drawings sheet accompanying this description shows, by way of non-restrictive example, an applicator of wax for depilation in accordance with this invention. FIGS. 1 to 4 show all the components thereof, with reference by way of example to a refillable cartridge with fixed head, in addition to being a primordial object of what shall be claimed as object of this invention.

Figure 1:
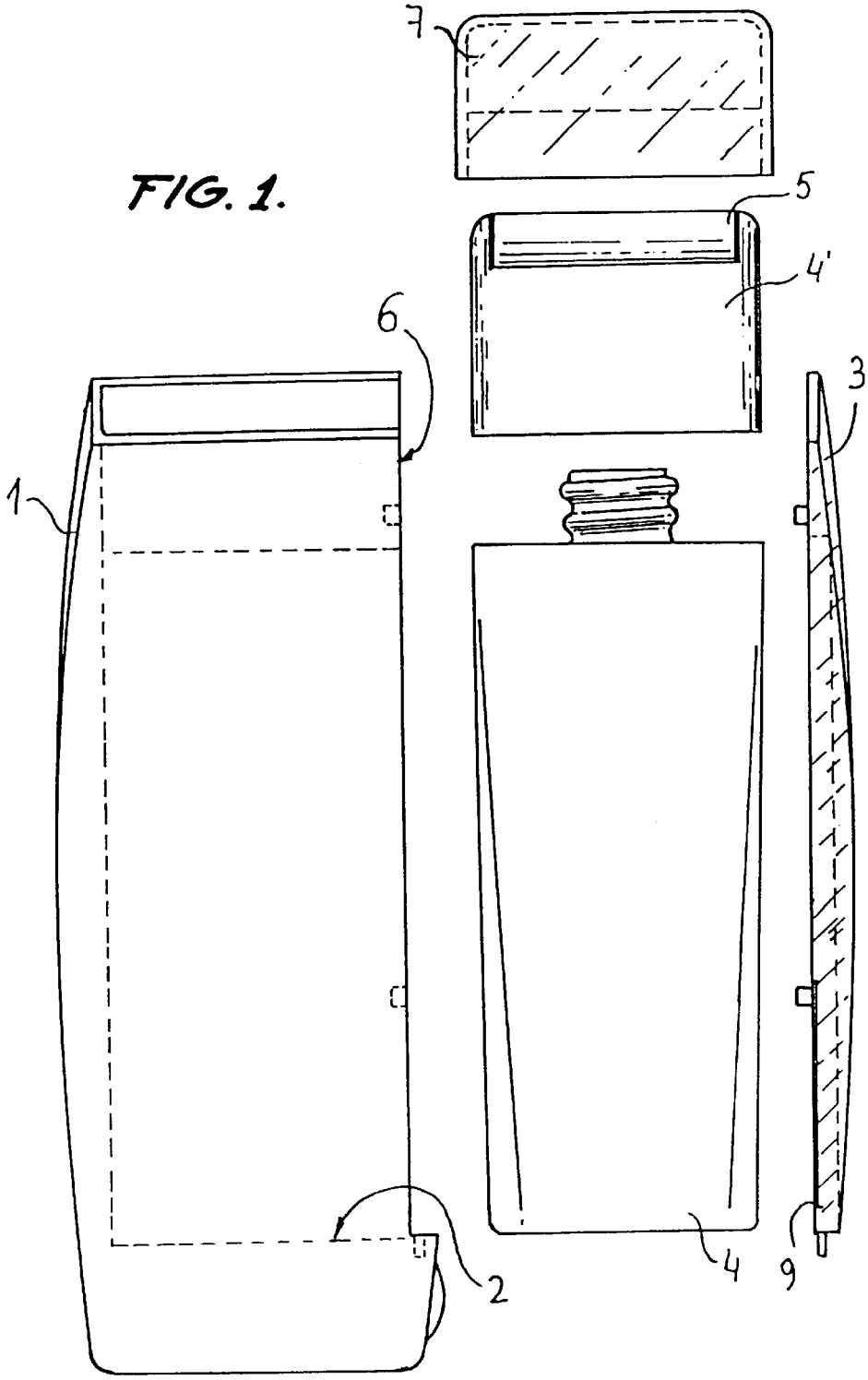
FIG. 1 illustrates an exploded view of the applicator of the present invention.

FIG. 1 therefore shows the aforesaid applicator in exploded form, showing the receiving body 1, with its interior sleeve 2 and transparent cover 3. This cover 3 is, at the same time, one of the side walls of the body 1 of the applicator. The cartridge is of the refillable type and is made up of the bodies 4 and 4' (these being in other cases a single body) with their roller 5. The cartridge 4–4' is inserted into the body 1 through the space destined for same in its open side 6. Once the cartridge 4–4' has been fitted the cover 3, that is the side wall of the body 1, is inserted leaving the whole closed and visible through said cover 3, which is transparent. Finally, the protective cover 7 is fitted, leaving the unit totally closed and ready for use.

Figure 2:
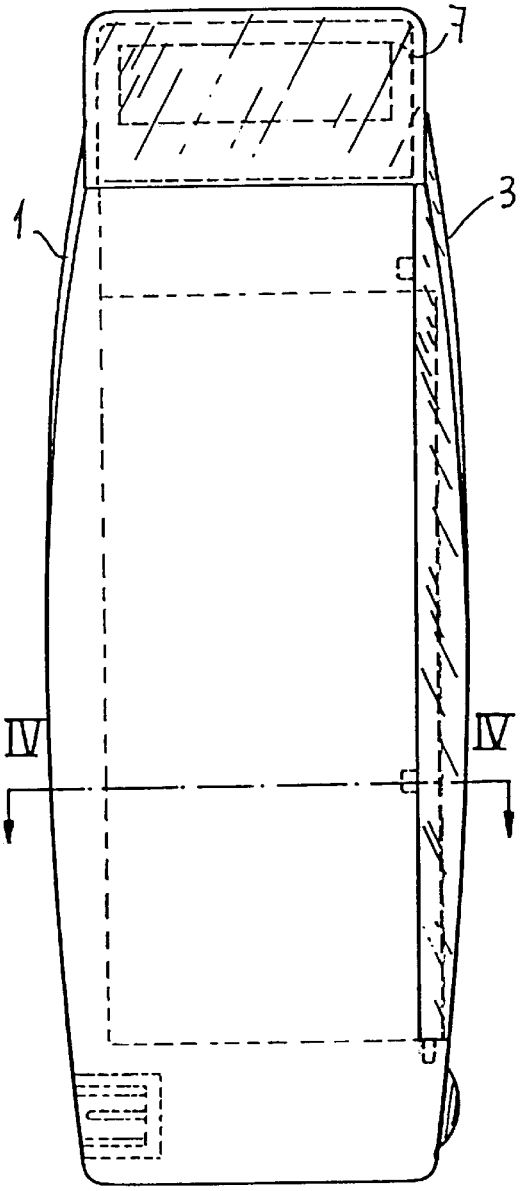
FIG. 2 illustrates the applicator of the present invention in assembled form.

FIG. 2 shows the result of the matters set out in the previous paragraph, in relation with fitting of the cartridge 4–4' inside the sleeve 2 through the opening 6, and in it the wall of the roller 5 can be seen to be covered by the body wall itself, permitting better heat distribution in this one.

Figure 3:
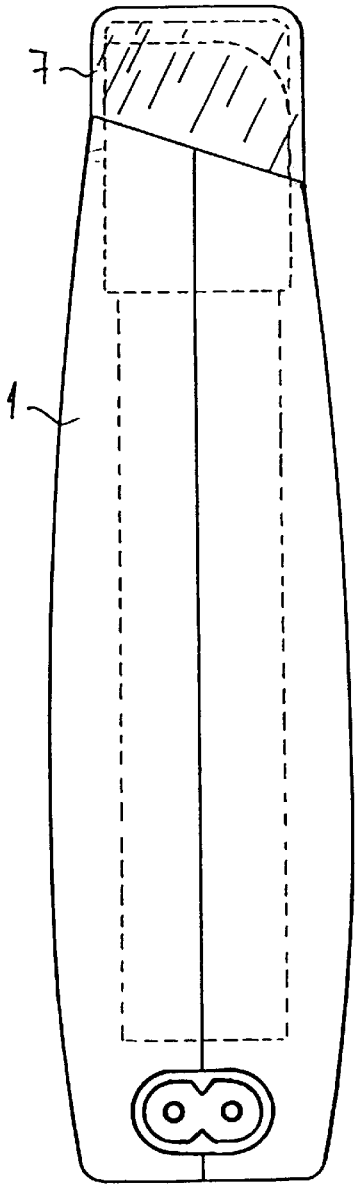
FIG. 3 illustrates a side view of the applicator shown in FIG. 2.

FIG. 3 is a side view of FIG. 2 and shows the same details, in relation to the applicator body, once it has been assembled.

Figure 4:
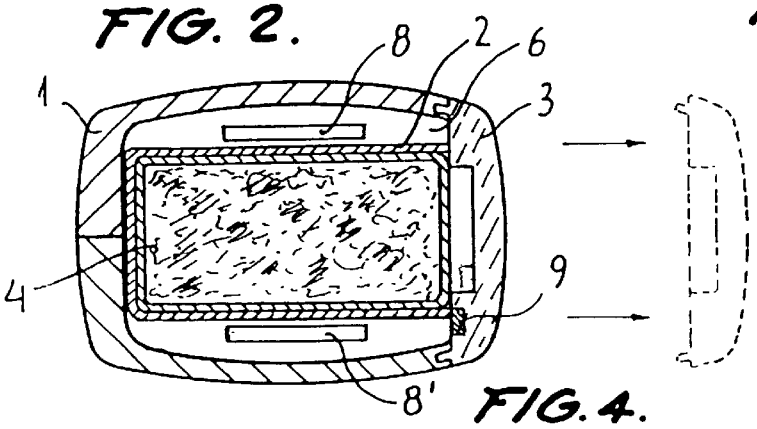
FIG. 4 illustrates a sectional view taken along lines IV—IV if FIG. 2.

FIG. 4 is a section along IV—IV of FIG. 2, showing the interrelationship of the parts forming the applicator, that is, the body 1 with its cover 3, sleeve 2, cartridge 4, heating elements 8–8' and sensors and/or viewing windows 9.

What is claimed is:

1. Wax applicator for depilation of the type made up of a wax cartridge (4–4') with a roller (5) in its head, which cartridge (4–4') is inserted into an electrically heat-activated sleeve (2) disposed within a body (1) of the applicator, characterized in that one of the side walls (3) is constituted by a removable cover which also closes said sleeve when mounted on said body, said removable cover transparent or partially transparent properties in accordance with the material of which it is made, and presenting a shape complementary to the other walls of the applicator.

2. Wax applicator, as claimed in claim 1, characterized in that the body (1) is totally constituted when an opening of U-shaped outline presented by the applicator with its heat-activated sleeve (2) is adapted to permit complementary insertion of the wax cartridge (4–4') with its roller (5) head; and then the U-shaped opening is covered by the removable cover (3), complementary and partially or totally transparent, which is fitted onto the rest of the body (1) by snapping on and off.

3. Wax applicator, as claimed in claim 1, characterized in that the removable cover (3) is fitted with temperature sensors and/or viewing windows, and sensors and/or viewing windows (9) to show the characteristics of the wax contained in the cartridge (4–4').

4. Wax applicator, as claimed in claim 3, characterized in that an upper portion of the U-shaped opening of the body (1) goes up to an upper zone of the roller (5) of the applicator cartridge (4–4'), thanks to the said cartridge (4–4') being inserted into the U-shaped opening in the body (1), permitting immobilization of the cartridge (4–4') thanks to the necessary narrowness to protect thermally said upper zone.

5. Wax applicator, as claimed in claim 2, characterized in that an upper portion of the U-shaped opening of the body (1) goes up to an upper zone of the roller (5) of the applicator cartridge (4–4'), thanks to the said cartridge (4–4') being inserted into the U-shaped opening in the body (1), permitting immobilization of the cartridge (4–4') thanks to the necessary narrowness to protect thermally said upper zone.

* * * * *

UNITED STATES PATENT AND TRADEMARK OFFICE

CERTIFICATE OF CORRECTION

PATENT NO. : 6,273,625 B1
DATED : August 14, 2001
INVENTOR(S) : Martinez, Luis

It is certified that error appears in the above-identified patent and that said Letters Patent is hereby corrected as shown below:

Title page,
Item [73], Assignee, delete "Ceras Especial Martinez de San Vincente, S.A." and insert -- Ceras Especiales Martinez de San Vicente, S.A. --.

Signed and Sealed this

Fifth Day of November, 2002

*Attest:*

*Attesting Officer*

JAMES E. ROGAN
*Director of the United States Patent and Trademark Office*